US012692748B2

(12) United States Patent
Ortiz et al.

(10) Patent No.: US 12,692,748 B2
(45) Date of Patent: Jul. 28, 2026

(54) SHOCK MOUNTING OF A MOTOR IN A DOWNHOLE TOOL

(71) Applicant: KING SOUTHWEST & CONSULTING OF CYPRESS, Houston, TX (US)

(72) Inventors: Santos D. Ortiz, Houston, TX (US); George R. King, Houston, TX (US); Kristopher L. Wilden, Houston, TX (US)

(73) Assignee: KING SOUTHWEST & CONSULTING OF CYPRESS, Houston, TX (US)

( * ) Notice: Subject to any disclaimer, the term of this patent is extended or adjusted under 35 U.S.C. 154(b) by 0 days.

(21) Appl. No.: 18/980,340

(22) Filed: Dec. 13, 2024

(65) Prior Publication Data

US 2026/0168328 A1 Jun. 18, 2026

(51) Int. Cl.
*E21B 4/18* (2006.01)
*E21B 4/00* (2006.01)

(52) U.S. Cl.
CPC ..... *E21B 4/18* (2013.01); *E21B 4/003* (2013.01)

(58) Field of Classification Search
CPC ..... E21B 4/003
See application file for complete search history.

(56) References Cited

U.S. PATENT DOCUMENTS

| | | | | |
|---|---|---|---|---|
| 7,465,280 | B2 | 12/2008 | Rawls-Meehan | |
| 8,444,123 | B2 | 5/2013 | Shoemaker et al. | |
| 11,235,635 | B2 | 2/2022 | Tucker et al. | |
| 11,808,092 | B2 | 11/2023 | King et al. | |
| 2021/0123325 | A1 | 4/2021 | Church et al. | |
| 2024/0240532 | A1 | 7/2024 | Ortiz et al. | |
| 2025/0027401 | A1 * | 1/2025 | DiFoggio ..... | F16F 15/002 |

FOREIGN PATENT DOCUMENTS

| | | | |
|---|---|---|---|
| DE | 3106122 | A1 | 12/1981 |

OTHER PUBLICATIONS

English language abstract of DE3106122 (A1); Espacenet; 2 pages.

* cited by examiner

*Primary Examiner* — Kristyn A Hall
(74) *Attorney, Agent, or Firm* — Smith IP Services, P.C.

(57) ABSTRACT

A downhole tool for use in a subterranean well can include an electric motor, a motor carrier, and a compressed gas chamber. The motor may be axially reciprocably received in the motor carrier. The compressed gas chamber may decrease in volume in response to displacement of the motor in an axial direction relative to the motor carrier. The chamber may be formed radially between the motor and the motor carrier.

19 Claims, 6 Drawing Sheets

SHOCK MOUNTING OF A MOTOR IN A DOWNHOLE TOOL

BACKGROUND

This disclosure relates generally to equipment utilized and operations performed in conjunction with a subterranean well and, in an example described below, more particularly provides for shock mounting of a motor in a downhole tool.

Tools designed for use in subterranean wells are typically required to be robust, so that extreme environmental conditions can be withstood by the tools. Various different types of tools are used downhole in wellbores. Some of these downhole tools include electric motors.

It will, therefore, be readily appreciated that improvements are continually needed in the art of designing, constructing and utilizing downhole tools that include electric motors. The present specification provides such improvements, which may be used with a variety of different types of downhole tools in a variety of different types of well operations.

DETAILED DESCRIPTION

Figure 1:
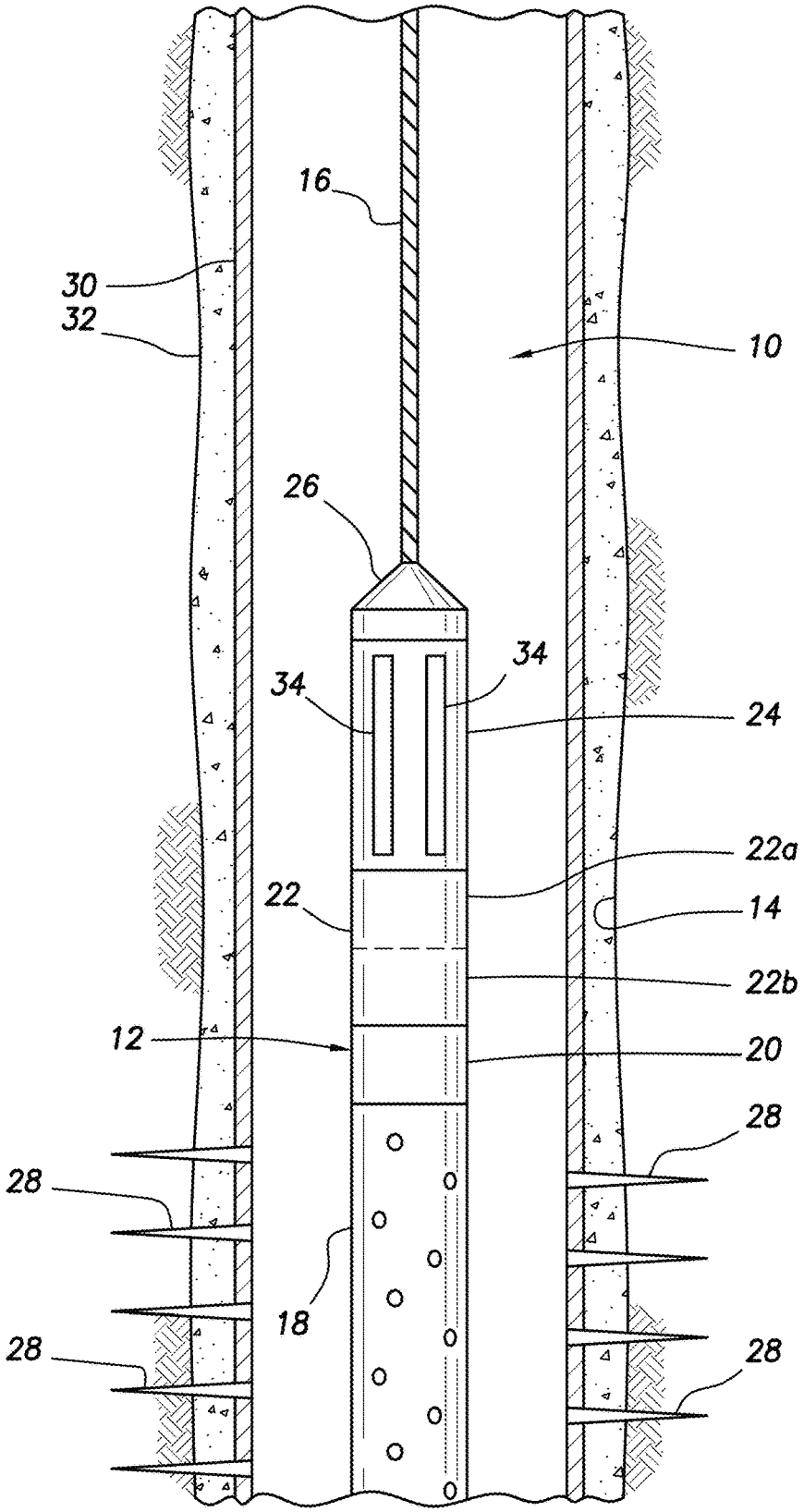
FIG. 1 is a representative partially cross-sectional view of an example of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a bottom hole assembly 12 is conveyed through a wellbore 14 by means of a conveyance 16. The conveyance 16 in this example is a wireline, slickline or "e-line" of the type including at least one electrical conductor for providing power and communication between a surface control system and the bottom hole assembly 12. In other examples, the conveyance 16 could be a coiled tubing string or another type of tubular string.

Note that it is not necessary for an electrical conductor to be provided for supplying power and communication between the surface and the bottom hole assembly 12. For example, a battery or a downhole electrical generator could be used to supply power to the bottom hole assembly 12, and/or various forms of telemetry (e.g., acoustic, electromagnetic, RFID, etc.) may be used for communication between the surface and the bottom hole assembly.

As depicted in FIG. 1, the bottom hole assembly 12 includes a perforator 18, a firing head 20, an electromechanical release tool 22, an instrument carrier 24 and an upper connection 26. In other examples, different components, different combinations of components and different configurations of components may be used in the bottom hole assembly 12. Thus, the scope of this disclosure is not limited to any particular components or arrangement of components in the bottom hole assembly 12.

The perforator 18 of FIG. 1 is of the type known to those skilled in the art as an explosive jet-type perforator. The perforator 18 includes multiple explosive shaped charges that, when detonated, form perforations 28 extending through casing 30 and cement 32 lining the wellbore 14. Other types of perforators (such as, abrasive jet perforators, drill perforators, etc.) may be used in other examples, and it is not necessary for the bottom hole assembly 12 to include the perforator 18.

The firing head 20 is used to initiate detonation of the shaped charges in the perforator 18. The firing head 20 may actuate the perforator 18 in response to a signal transmitted from the surface via an electrical conductor or telemetry, or in response to another stimulus. If the perforator 18 does not include explosive shaped charges, or if the perforator is not used in the bottom hole assembly 12, then the firing head 20 may not be used.

The release tool 22 enables the perforator 18 and firing head 20 (and any other components of the bottom hole assembly 12 connected below the perforator) to be disconnected from an upper section of the bottom hole assembly and the conveyance 16. This will allow the upper section of the bottom hole assembly 12 to be retrieved from the wellbore 14 apart from the lower section of the bottom hole assembly, for example, in the event that the lower section becomes stuck in the wellbore.

In the FIG. 1 example, the release tool 22 is operable in response to a signal transmitted from the surface via the electrical conductor of the conveyance 16. When the release tool 22 is actuated, an upper portion 22*a* of the release tool can be disconnected from a lower portion 22*b* of the release tool.

The instrument carrier 24 transports instruments 34 (such as, pressure and temperature gauges, vibration or shock sensors, or other types of sensors) in the bottom hole assembly 12. Such instruments 34 can be relatively delicate and sensitive to shock due to detonation of the shaped charges in the perforator 18. In the FIG. 1 example, however, the release tool 22 is capable of damping the shock produced when the perforator 18 is fired, so that the instruments 34 are protected from the shock.

In some examples, the instruments 34 could be incorporated into the release tool 22. The instruments 34 could, for example, be positioned in or adjacent an electrical motor assembly 54 (see FIG. 2B) of the release tool 22. It is contemplated that shock will be less severe within the release tool 22 than above the release tool, but that shock above the release tool will be less severe than shock experienced below the release tool.

Note that, in the FIG. 1 example, the release tool 22 is connected in the bottom hole assembly 12 between the perforator 18 and the instrument carrier 24. If the instrument carrier 24 is used in the bottom hole assembly 12 without the perforator 18, then it may be desirable to position the release tool 22 above the instrument carrier. Thus, the scope of this disclosure is not limited to any particular position of the release tool 22 relative to any other component(s) of the bottom hole assembly 12.

The release tool 22 is one example of a downhole tool that can incorporate the principles of this disclosure. Other types of downhole tools (such as, firing heads, fluid samplers, valves, anchors, setting tools, actuators, caliper tools, powered centralizers, downhole shut-in tools, powered jars, electrotechnical cutting tools, etc.) can also benefit from application of the principles of this disclosure.

Figure 2A:
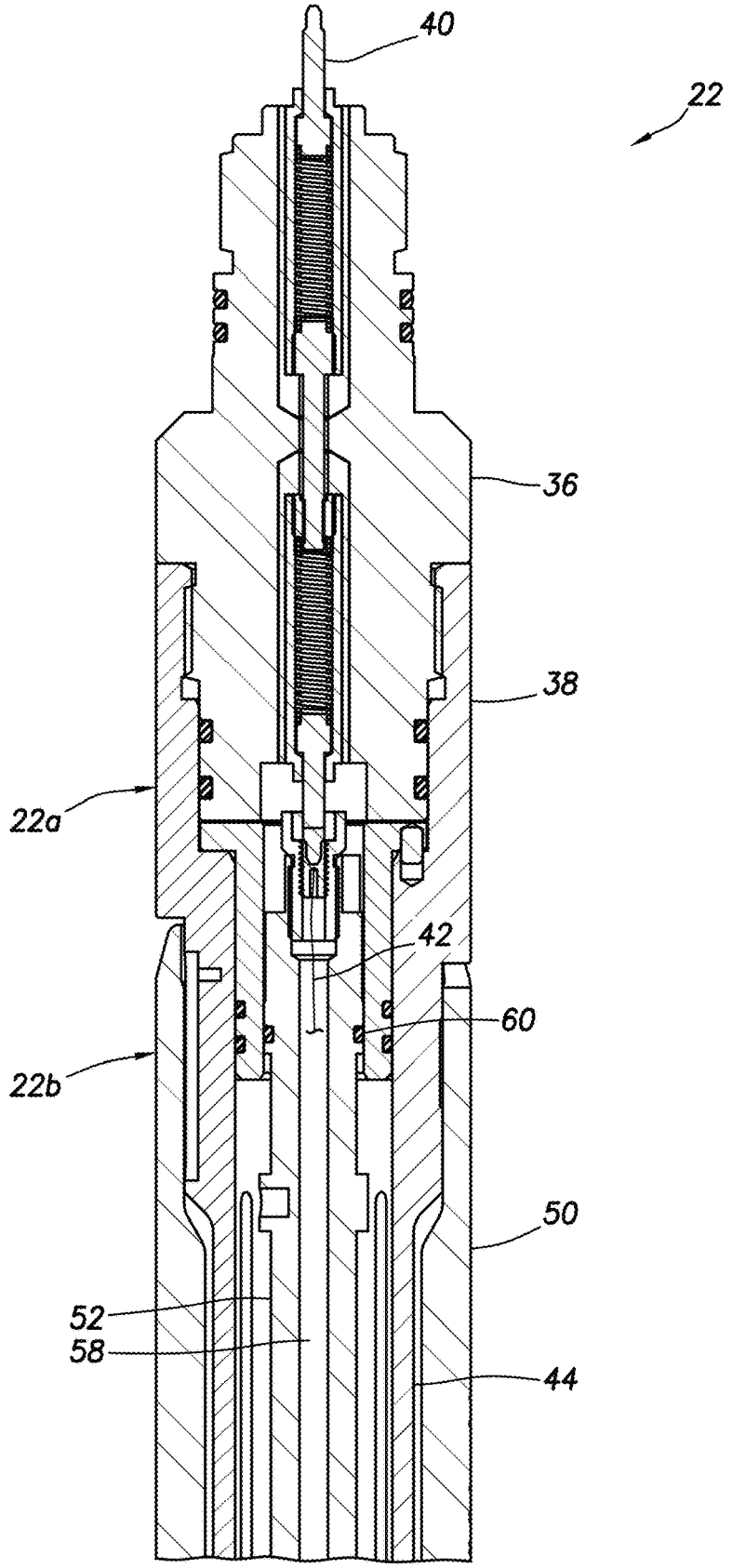
FIGS. 2A-C are representative cross-sectional views of an example of an electromechanical release tool that may be used with the FIG. 1 system and method.
Figure 2B:
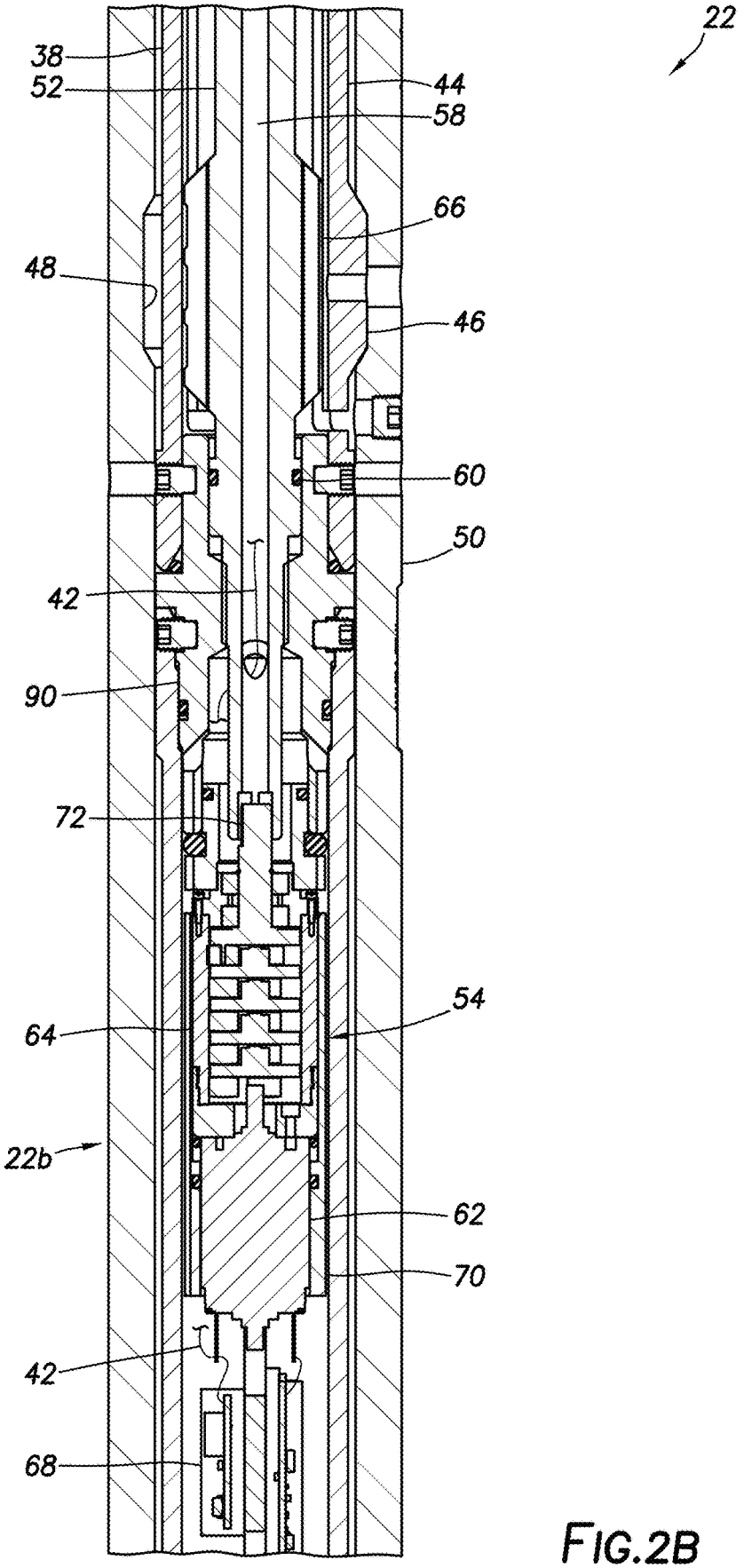
Figure 2C:
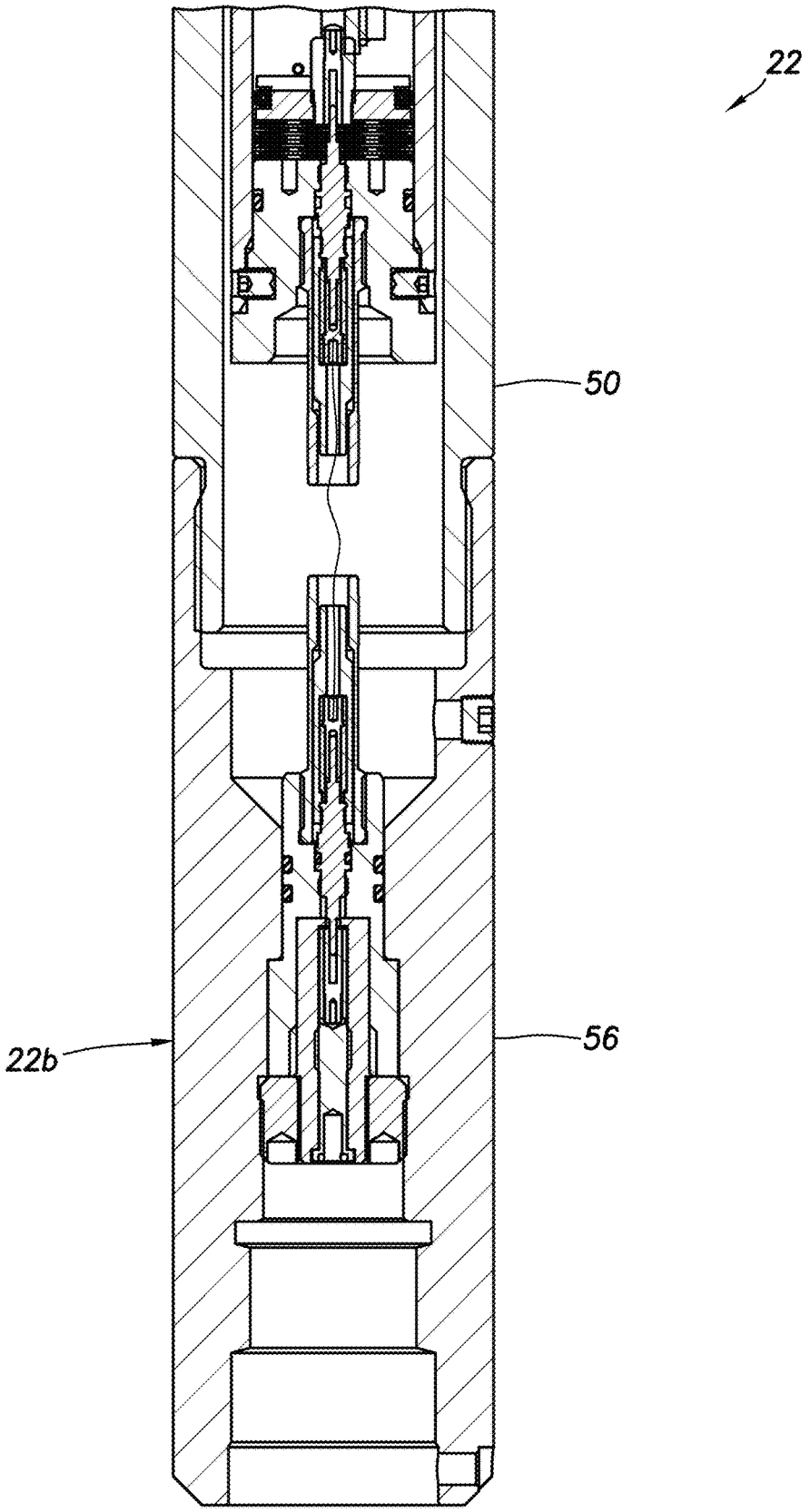

Referring additionally now to FIGS. 2A-C, cross-sectional views of a more detailed example of the release tool 22 is representatively illustrated. The FIGS. 2A-C release tool 22 may be used in the system 10 and method of FIG. 1, or it may be used with other systems and methods. The FIGS. 2A-C release tool 22 is similar in many respects to a release tool described in U.S. Pat. No. 11,808,092 the entire disclosure of which is incorporated herein by this reference for all purposes.

In the FIGS. 2A-C example, the upper portion 22*a* of the release tool 22 includes a top sub 36 and a collet sub 38. The top sub 36 provides for connecting the release tool 22 to components (such as the instrument carrier 24 or the upper connector 26) above the release tool 22.

An electrical connector 40 connects to the electrical conductor in the conveyance 16, via the instrument carrier 24 or any other components connected between the conveyance and the release tool 22. In this manner, an electrical conductor 42 of the release tool 22 is in electrical communication with the conductor of the conveyance 16. If, however, the release tool 22 is provided with electrical power via batteries or a generator, the electrical connector 40 may not be used.

The collet sub 38 includes downwardly extending and circumferentially spaced apart flexible collets 44 having radially enlarged engagement members 46. The engagement members 46 are radially outwardly engaged with a radially enlarged recess or profile 48 formed in an outer generally tubular body 50 of the lower portion 22*b*.

The lower portion 22*b* of the release tool 22 includes the body 50, an inner mandrel 52, an electric motor assembly 54 and a lower connector 56. The lower connector 56 mechanically and electrically connects the release tool 22 to components of the bottom hole assembly 12 below the release tool (such as the firing head 20 and perforator 18).

The inner mandrel 52 includes an inner passage 58 extending longitudinally through most of the inner mandrel, so that the conductor 42 can extend through the passage from the upper connector 36 to the electric motor assembly 54. Seals 60 are provided on opposite ends of the inner mandrel 52 to isolate the passage 58 from well fluids and pressures.

The electric motor assembly 54 includes an electric motor 62, a gearbox 64 and a motor controller 68. The motor 62 and gearbox 64 are mounted in a motor carrier 70. As described more fully below, the electric motor assembly 54 also includes a gas spring feature that mitigates shock loading on the motor 62 and gearbox 64.

The motor controller 68 is electrically connected to the conductor 42, so that when an appropriate electrical signal is transmitted via the conductor 42, the motor controller 68 actuates the motor 62 to produce rotation of an output shaft connected to an input shaft of the gearbox 64. The motor controller 68 may include a hardware or software "switch" that supplies electrical power to the motor 62 when the appropriate electrical signal is received via the conductor 42.

An output shaft 72 of the gearbox 64 is connected to the inner mandrel 52. Thus, when the motor 62 is supplied with an appropriate electrical signal, the motor rotates, the gearbox 64 reduces an output speed and increases an output torque of the motor, and the inner mandrel 52 is thereby rotated.

Preferably, the connection between the output shaft 72 and the inner mandrel 52 provides for axial displacement of the motor 62 and gearbox 64 relative to the inner mandrel. For example, splines or a key and keyway could provide for relative axial movement, while still allowing torque to be transmitted from the output shaft 72 to the inner mandrel 52.

The inner mandrel 52 has multiple circumferentially spaced apart radially enlarged lobes 66 formed thereon. As depicted in FIG. 2B, the lobes 66 are radially aligned with and radially outwardly support the collet engagement members 46 in engagement with the profile 48 in the outer body 50. Thus, the outer body 50 and the remainder of the lower portion 22*b* of the release tool 22 is prevented from separating from the collet sub 38 and the remainder of the upper portion 22*a* of the release tool.

However, when the inner mandrel 52 is rotated by the motor assembly 54, the lobes 66 will no longer be radially aligned with the engagement members 46 of the collets 44. At that point, the lobes 66 will no longer radially outwardly support the collet engagement members 46 in engagement with the profile 48 in the outer body 50, and the upper and lower portions 22*a,b* of the release tool 22 will then be able to separate from each other.

In other examples, the inner mandrel 52 could be longitudinally displaced, so that the lobes 66 are no longer longitudinally aligned with the engagement members 46 of the collets 44. In this manner, the lobes 66 will no longer radially outwardly support the collet engagement members 46 in engagement with the profile 48 in the outer body 50, and the upper and lower portions 22*a,b* of the release tool 22 will then be able to separate from each other. The inner mandrel 52 can be displaced in any direction electromechanically (as in the example of the electric motor assembly 54), or hydrostatically (e.g., using a piston drive and well pressure).

Figure 3:
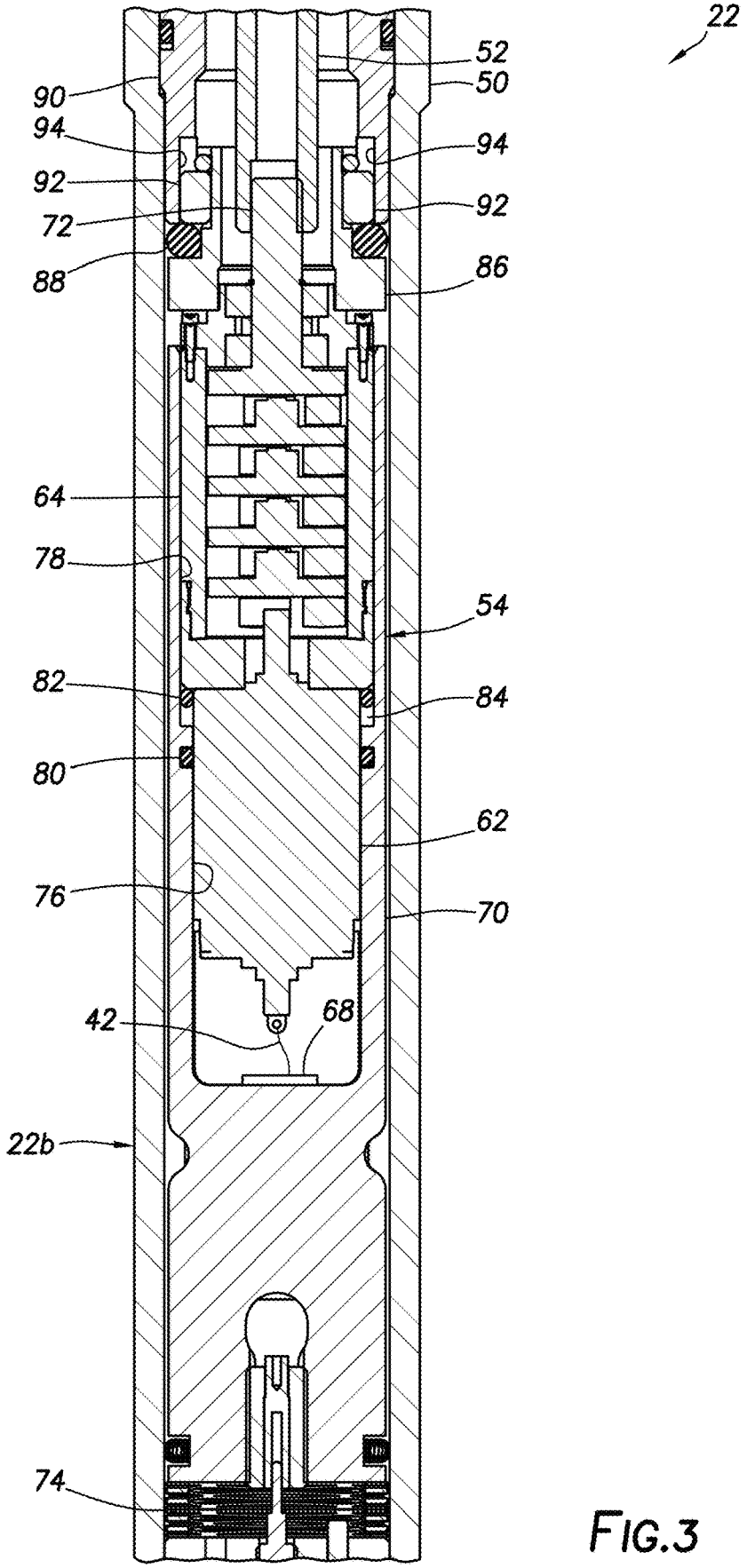
FIG. 3 is a representative cross-sectional view of an example of a motor section of the release tool in an operative configuration.

Referring additionally now to FIG. 3, a cross-sectional view of the motor section of the release tool 22 is representatively illustrated. The FIG. 3 cross-sectional view is rotated 90 degrees from the FIGS. 2A-C views. In the FIG. 3 view, the release tool 22 is in an operative run-in configuration.

As depicted in FIG. 3, the release tool 22 includes a spring 74 that biases the motor carrier 70 upward (as viewed in FIG. 3). The spring 74 comprises multiple annular wave springs in this example, but in other examples other types of springs may be used (such as, a coiled spring, Bellville washers, a compressed gas chamber, an elastomer, etc.).

The motor carrier 70 includes a bore 76 in which the motor 62 is axially reciprocably received, and another bore 78 in which the gearbox 64 is axially reciprocably received. A seal 80 (such as, an o-ring, etc.) seals between the motor 62 and the bore 76. Another seal 82 (such as, an o-ring, etc.) seals between the motor 62, the gearbox 64 and the bore 78, so that an annular chamber 84 is isolated between the seals 80, 82.

The chamber 84 in this example is filled with air when the release tool 22 is assembled. In other examples, another gas (such as, nitrogen, argon, etc.) may be introduced into the chamber 84 when the release tool 22 is assembled.

The motor 62 and gearbox 64 are prevented from displacing axially upward from their FIG. 3 positions by abutment of an upper flange 86 against an elastomer bumper 88 (such as, an o-ring, etc.) interposed between the upper flange and a connector 90 secured to the collet sub 38 (see FIG. 2B). Keys 92 received in keyways 94 permit axial displacement of the flange 86 relative to the connector 90.

Thus, the biasing force exerted by the spring 74 compresses the chamber 84 between the seals 80, 82, since the motor carrier 70 can displace upward somewhat, but the motor 62 and gearbox 64 are substantially prevented from displacing upward. The spring 74 will displace the motor carrier 70 upward until pressure in the chamber 84 is increased (due to compression of the chamber) sufficiently to balance the biasing force exerted by the spring.

Figure 4:
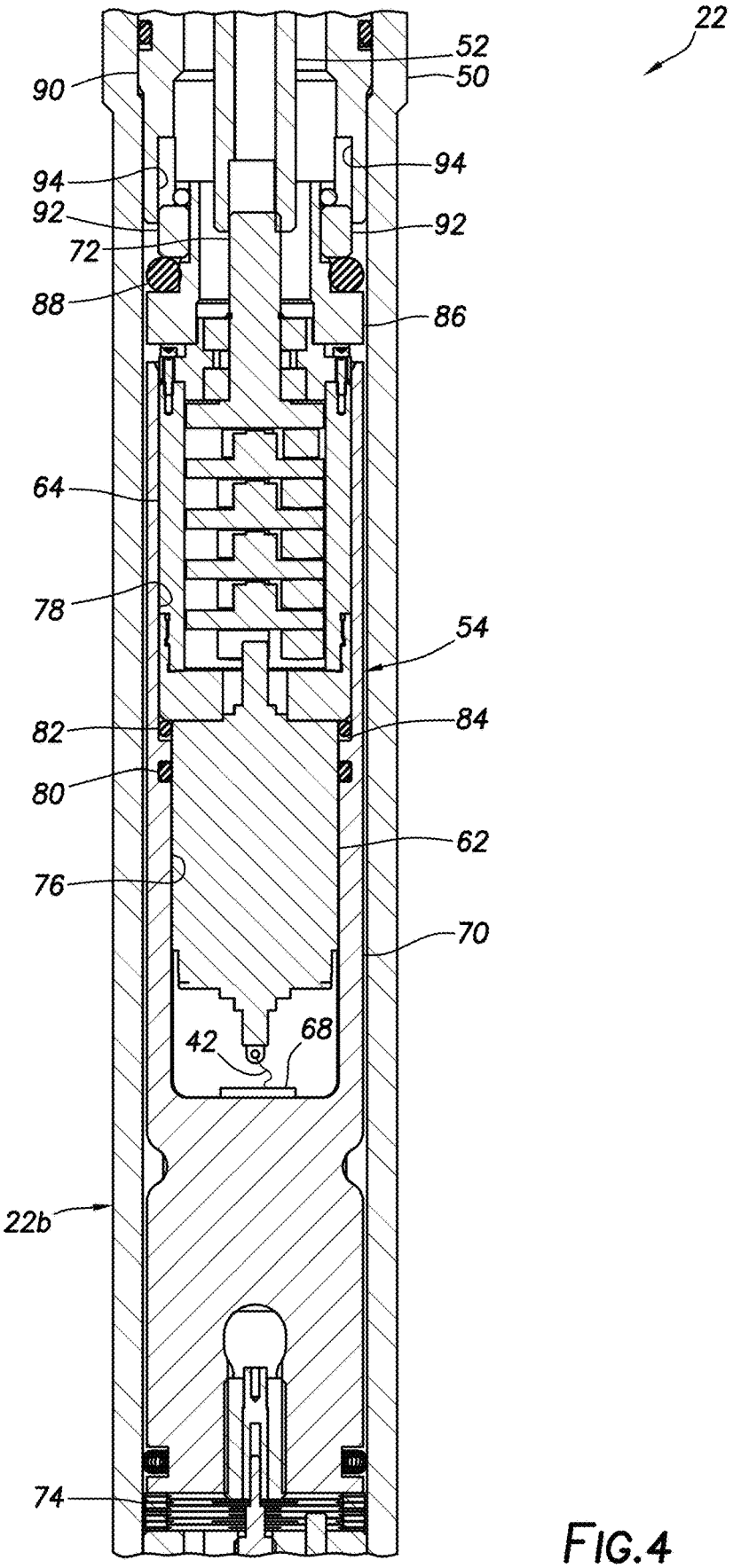
FIG. 4 is a representative cross-sectional view of the motor section in a shock loaded configuration.

Referring additionally now to FIG. 4, another cross-sectional view of the motor section of the release tool 22 is representatively illustrated. In this view, the release tool 22 is exposed to shock loading. For example, the release tool 22 may have experienced an impact, the perforator 18 may have been detonated, a setting tool, casing cutter, drill collar severing tool or jar may have been actuated, etc.

As a result of acceleration being imparted to the release tool 22 by the shock loading, the motor 62, gearbox 64 and motor carrier 70 have displaced downward (as viewed in FIG. 4). The axially compliant connections between the output shaft 72 and the inner mandrel 52, and between the upper flange 86 and the connector 90, allow for such axial movement of the motor 62 and gearbox 64.

The spring 74 has been axially compressed by the downward displacement of the motor carrier 70. The chamber 84 has also been axially compressed, so that a volume of the chamber is decreased.

The axial compressions of the spring 74 and the chamber 84 act to dissipate the kinetic energy of the shock loading. This dissipation of energy will mitigate damage to the motor 62 and gearbox 64 due to the shock loading, thereby providing longer useful lives for these components.

The motor 62, gearbox 64 and motor carrier 70 will eventually return to their FIG. 3 positions. The spring 74 will upwardly bias the motor carrier 70 to its FIG. 3 position, and the chamber 84 will upwardly bias the motor 62 and gearbox 64 to their FIG. 3 positions.

It may now be fully appreciated that the above disclosure provides significant advancements to the art of designing, constructing and utilizing downhole tools that include electric motors. In an example described above, the release tool 22 (or another downhole tool) includes a compressed gas chamber 84 that biases the motor 62 and gearbox 64 in one axial direction, and the chamber is compressed when the motor and gearbox displace in an opposite axial direction.

The above disclosure provides to the art a downhole tool 22 for use in a subterranean well. In one example, the downhole tool 22 can comprise: an electric motor 62, a motor carrier 70, the motor 62 being axially reciprocably received in the motor carrier 70, and a compressed gas chamber 84 configured to decrease in volume in response to displacement of the motor 62 in an axial direction relative to the motor carrier 70.

The downhole tool 22 can include a spring 74 that biases the motor carrier 70 in an axial direction opposite to the first axial direction. The chamber may bias the motor 62 in the second axial direction.

The downhole tool 22 may include a first seal 80 that seals between the motor 62 and the motor carrier 70. The downhole tool 22 may include a second seal 82 axially spaced apart from the first seal 80, the chamber 84 being isolated between the first and second seals 80, 82.

The second seal 82 may seal between the motor 62 and the motor carrier 70. The second seal 82 may further seal between the motor 62 and a gearbox 64.

The gearbox 64 may be axially reciprocably received in the motor carrier 70. The chamber 84 may be formed axially between the gearbox 64 and the motor carrier 70. The chamber 84 may be formed radially between the motor 62 and the motor carrier 70.

An output shaft 72 of the gearbox 64 may be configured to transfer torque from the gearbox 64 to an inner mandrel 52 of the downhole tool 22 while the output shaft 72 is axially reciprocable relative to the inner mandrel 52.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A downhole tool for use in a subterranean well, the downhole tool comprising:

an electric motor;

a motor carrier, the motor being axially reciprocably received in the motor carrier;

a compressed gas chamber configured to decrease in volume in response to displacement of the motor in a first axial direction relative to the motor carrier; and a spring that biases the motor carrier in a second axial direction opposite to the first axial direction.

2. The downhole tool of claim 1, in which the chamber biases the motor in the second axial direction.

3. The downhole tool of claim 1, further comprising a first seal that seals between the motor and the motor carrier.

4. The downhole tool of claim 3, further comprising a second seal axially spaced apart from the first seal, the chamber being isolated between the first and second seals.

5. The downhole tool of claim 4, in which the second seal seals between the motor and the motor carrier.

6. The downhole tool of claim 5, in which the second seal further seals between the motor and a gearbox.

7. The downhole tool of claim 6, in which the gearbox is axially reciprocably received in the motor carrier.

8. The downhole tool of claim 6, in which the chamber is formed axially between the gearbox and the motor carrier.

9. The downhole tool of claim 1, in which the chamber is formed radially between the motor and the motor carrier.

10. A downhole tool for use in a subterranean well, the downhole tool comprising:

an electric motor;

a motor carrier, the motor being axially reciprocably received in the motor carrier; and a compressed gas chamber configured to decrease in volume in response to displacement of the motor in a first axial direction relative to the motor carrier, the entire chamber being formed radially between the motor and the motor carrier, in which pressure within the chamber increases in response to the decrease in volume.

11. The downhole tool of claim 10, further comprising a spring that biases the motor carrier in a second axial direction opposite to the first axial direction.

12. The downhole tool of claim 11, in which the chamber biases the motor in the second axial direction.

13. The downhole tool of claim 10, further comprising a first seal that seals between the motor and the motor carrier.

14. The downhole tool of claim 13, further comprising a second seal axially spaced apart from the first seal, the chamber being isolated between the first and second seals.

15. The downhole tool of claim 14, in which the second seal seals between the motor and the motor carrier.

16. The downhole tool of claim 15, in which the second seal further seals between the motor and a gearbox.

17. The downhole tool of claim 16, in which the gearbox is axially reciprocably received in the motor carrier.

18. The downhole tool of claim 16, in which the chamber is formed axially between the gearbox and the motor carrier.

19. The downhole tool of claim 16, in which an output shaft of the gearbox is configured to transfer torque from the gearbox to an inner mandrel of the downhole tool while the output shaft is axially reciprocable relative to the inner mandrel.

* * * * *